United States Patent [19]

Reuter et al.

[11] Patent Number: 4,578,958

[45] Date of Patent: Apr. 1, 1986

[54] CONSUMPTION METERING SYSTEM FOR AN AIR CONDITIONING SYSTEM

[75] Inventors: Rolf Reuter, Essen; Norbert Hilscher, Krefeld, both of Fed. Rep. of Germany

[73] Assignee: Maurmann Ingenieurburo GmbH, Heiligenhaus, Fed. Rep. of Germany

[21] Appl. No.: 635,043

[22] Filed: Jul. 27, 1984

[30] Foreign Application Priority Data

Feb. 22, 1984 [DE] Fed. Rep. of Germany ..... 3406405

[51] Int. Cl.[4] ..... G05D 23/00; G01K 17/00

[52] U.S. Cl. ..... 62/126; 165/11.1; 236/49; 236/94; 374/29

[58] Field of Search ..... 236/49, 94; 165/11; 374/29

[56] References Cited

U.S. PATENT DOCUMENTS 3,995,686 12/1976 Laube ..... 165/11 R
4,049,044 9/1977 Cohen ..... 165/11 R
4,186,563 2/1980 Schulze, Sr. ..... 236/94 X
4,308,992 1/1982 Horton ..... 165/11 R

FOREIGN PATENT DOCUMENTS 112945 9/1980 Japan ..... 236/94

*Primary Examiner*—William E. Wayner
*Attorney, Agent, or Firm*—Lee, Smith & Zickert

[57] ABSTRACT

With an air conditioning system a plurality of building areas, for which individual energy accounts have to be rendered, are supplied by a common fresh air supply and cooling installation. The volume flow rates are controlled by one volume flow rate regulator each, the setpoint of which is adjustable through a servomotor. An output signal representing the setpoint of the volume flow rate regulator is generated and is applied to a meter. This provides with sufficient accuracy the distribution of the volume flow rates between the various building areas as a base for the accounting and billing of energy expenses.

10 Claims, 3 Drawing Figures

CONSUMPTION METERING SYSTEM FOR AN AIR CONDITIONING SYSTEM

The invention relates to a consumption metering system for an air conditioning system, wherein a plurality of building areas which are to be metered individually are supplied from a common fresh air supply and cooling installation, and wherein the volume flow rates to the individual building areas are controlled by one volume flow rate regulator each, a servomotor being arranged to adjust the setpoint of said regulator.

Many buildings have a central air conditioning system which provides fresh air and cool air for all areas of the building. In many cases, however, different users (tenants) are located in the various building areas, said different users having largely different consumptions of cool air or heat. A typical example is a building comprising a plurality of different shops. This presents the problem of distributing the expenses of the air conditioning system fairly between the users of the various building areas in accordance with their actual consumption.

It is the object of the invention to provide a consumption metering system for an air conditioning system, such that the metering system permits fair distribution of the operating expenses of the air conditioning system between the various building areas in accordance with the actual consumption.

According to the invention this object is achieved in that (a) a signal generator is arranged to be adjusted together with the setpoint of the volume flow rate regulator to provide an output signal variable with said setpoint, and (b) said output signal is applied to a meter.

Thus not directly the volume flow rate of the fresh air is measured which is supplied to a particular building area. Such a measurement would be extraordinarily complicated. The invention makes use of the fact that the volume flow rate conventionally is controlled by a volume flow rate regulator. In the simplest case such a volume flow rate regulator consists of a flap valve arranged in the air supply passage and being pushed open by the air flow against the action of a spring. In order to vary the volume flow rate, the pre-tension of the spring can be varied by a servomotor. This causes variation of the setpoint of the volume flow rate regulator. This setpoint is converted into a corresponding output signal and is applied to a meter. It is then possible, with sufficient accuracy, to determine the quantity of fresh air supplied to the respective building area.

Two embodiments of the invention are described hereinbelow with reference to the accompanying drawings.

Figure 1:
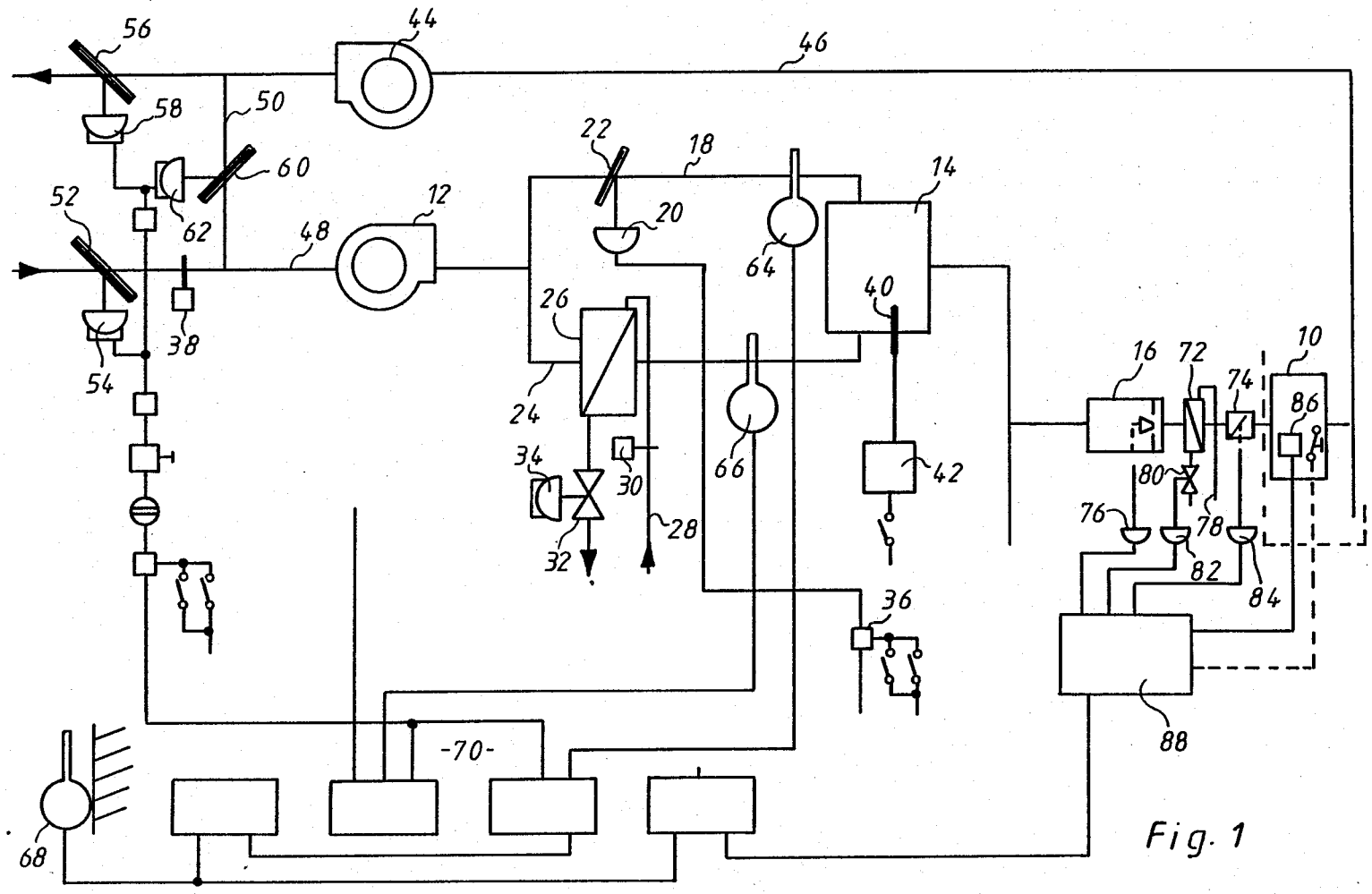
FIG. 1 is a schematic illustration of an air conditioning system.

Outer air is supplied to a building area 10, for example to a shop, through a blower 12 and an equalizing chamber 14 as well as through a volume flow rate regulator 16. The flow path divides between the blower 12 and the equalizing chamber 14. One partial path 18 can be shut off by a flap valve 22 arranged to be actuated by a servomotor 20. A second partial path 24 contains a cooling installation 26. The cooling installation is flown through by a cold water system 28. The inlet temperature of the cold water system 28 is measured by a cold water thermostat 30. Furthermore the cold water system 28 comprises a valve 32 which is arranged to be adjusted by a servomotor 34. The servomotor 20 is controlled by a control device 36. The servomotor 20 closes flap valve 22, when the outdoor temperature, which is measured by thermostat 38, exceeds a predetermined value, the cold water temperature drops below a certain value of, for example, 10° C., and the blower 12 is switched to its lowest stage.

The pressure in the equalizing chamber 14 is measured by a ring balance 40 and is controlled by a pressure regulator 42, which is adapted to switch the blower 12 between a low and a higher stage.

The outgoing air from the building areas, and thus also from the building area 10, is drawn off by a blower 44 which is arranged in an air return duct 46. A connecting duct 50 is provided between the air intake duct 48 containing the blower 12 and the air return duct 46. The air intake duct 48 communicates with atmosphere through a flap valve 52. Flap valve 52 is adjustable by means of a servomotor 54. The air return duct 46 communicates with atmospherre through a flap valve 56. Flap valve 56 is adjustable by means of a servomotor 58. Eventually the connecting duct 50 contains a flap valve 60, which is adjustable by means of a servomotor 62. Flaps 52, 56 and 60 are controlled by control means 70 as a function of temperatures, which are measured by temperature sensors 64,66,68 in the branches 18 and 24 and at the outside of the building, respectively. This is well known to those skilled in the art and, therefore, has not been illustrated and described in detail.

A heating device 72 is arranged downstream of each volume flow rate regulator 16 to permit heating of the air supplied. In addition a shut-off flap valve 74 is arranged in the air supply duct to each of the building areas 10. The setpoint of the volume flow rate regulator 16 is adjustable by a servomotor 76. The heating device comprises a heating liquid system 78 with a valve 80, which is adjustable by a servomotor 82. Eventually the shut-off flap valve 74 is arranged to be actuated by a servomotor 84. The servomotors 76,82 and 84 as well as a room temperature controller 86 are connected to a control and metering device 88.

Figure 2:
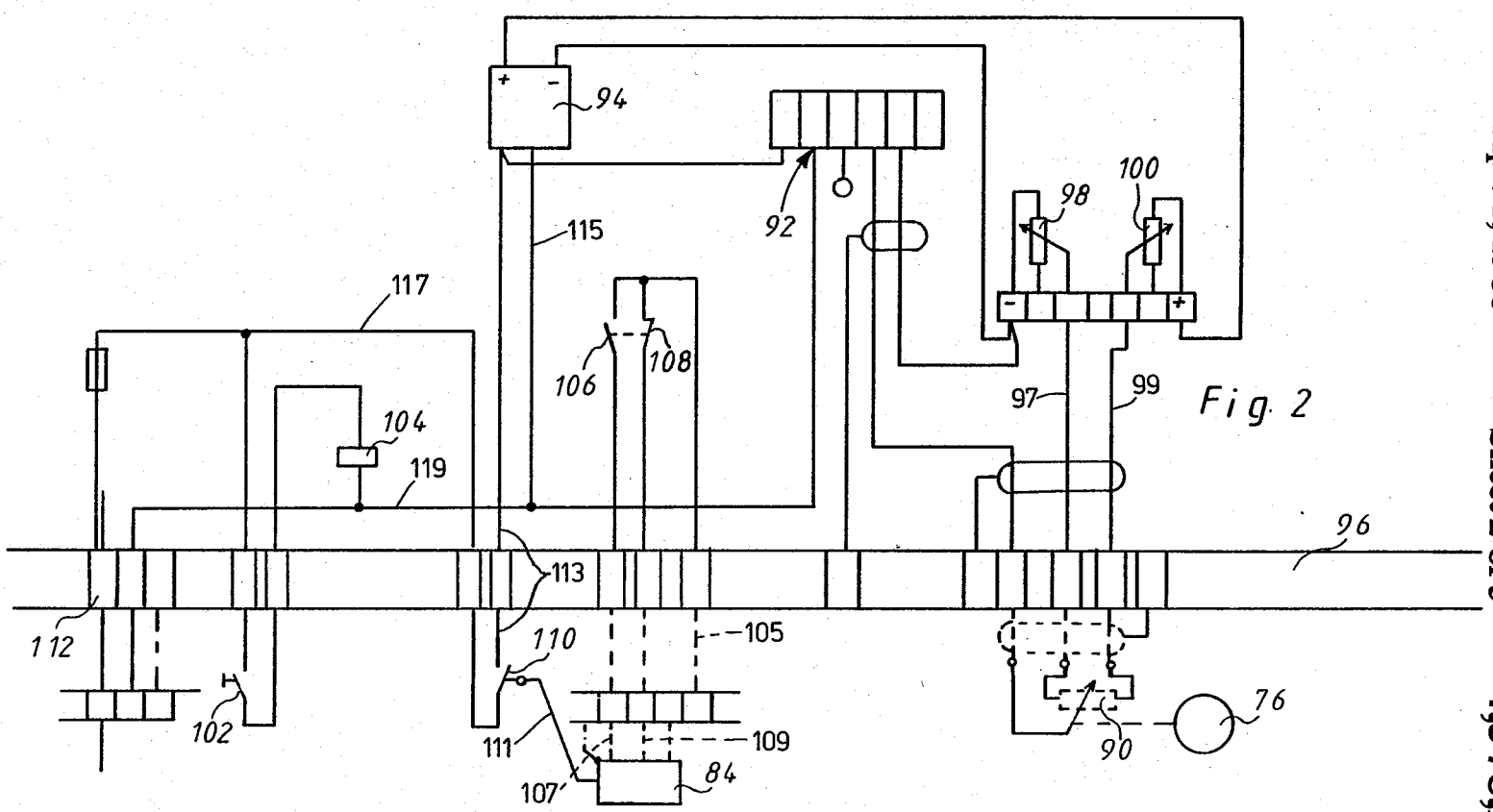
FIG. 2 shows a consumption metering system in combination with a volume flow rate regulator adjustable by an electric servomotor.

One example of a consumption metering system is illustrated in FIG. 2. The servomotor 76 for adjusting the setpoint of the volume flow rate regulator 16 is coupled with a potentiometer 90. The voltage tapped from the potentiometer 90 as output signal is applied to a meter 92. The meter is a known d.c. meter comprising a counter driven by an integrating motor. The potentiometer 90 is fed by a stabilized power supply unit 94, which is connected to the mains, in a way to be described hereinbelow, through a strip terminal 96. Trimming resistors 98,100 are series connected via respective lines 97,99 with the potentiometer 90 for accurate adjustment of the variation range.

The servomoter 84 is utilized to actuate the shut-off flap valve 74. The servomotor 84 obtains voltage which is supplied through either the contact 106 or the contact 108. As is conventional, the polarity of contact determines the direction of rotation of the servomotor 84 and therefore the opening or closing of the valve 74. For example, line 107 leading from the servomotor 84 is an "open" line and line 109 is a "closed" line in relation to the opened switch 106 and the closed switch 108. Supply to the switches 106 and 108 is through a line 105.

As also shown in FIG. 2, there is a mechanical connection 111 between the servomotor 84 and the switch 110. The servomotor 84 opens the switch 110 when the flap valve 74 is in its fully closed position. With switch 110 open, power to the power supply unit 94 via line 113 through a terminal of the strip terminal 96 is disconnected. Connection of the power supply unit 94 is through lines 113, 115, 119 and 117, as shown. With the switch 110 open as illustrated, the power supply unit 94 is disconnected.

The switch 102 may be used to shut-off the fresh air supply to a particular area of the building. When the switch 102 is closed, as can be seen by the line connection in FIG. 2, the relay 104 is energized. Relay contacts 106 and 108 are contacts of the relay 104. When the relay 104 is energized, the relay contact 108 is opened and the relay contact 106 is closed. By this step, the servomotor 84 is energized to open the flap valve 74. On the other hand, by the opposite sequence of steps, when the flap valve 74 is closed, power to the supply 94 is interrupted, therefore shutting off the meter 92.

Figure 3:
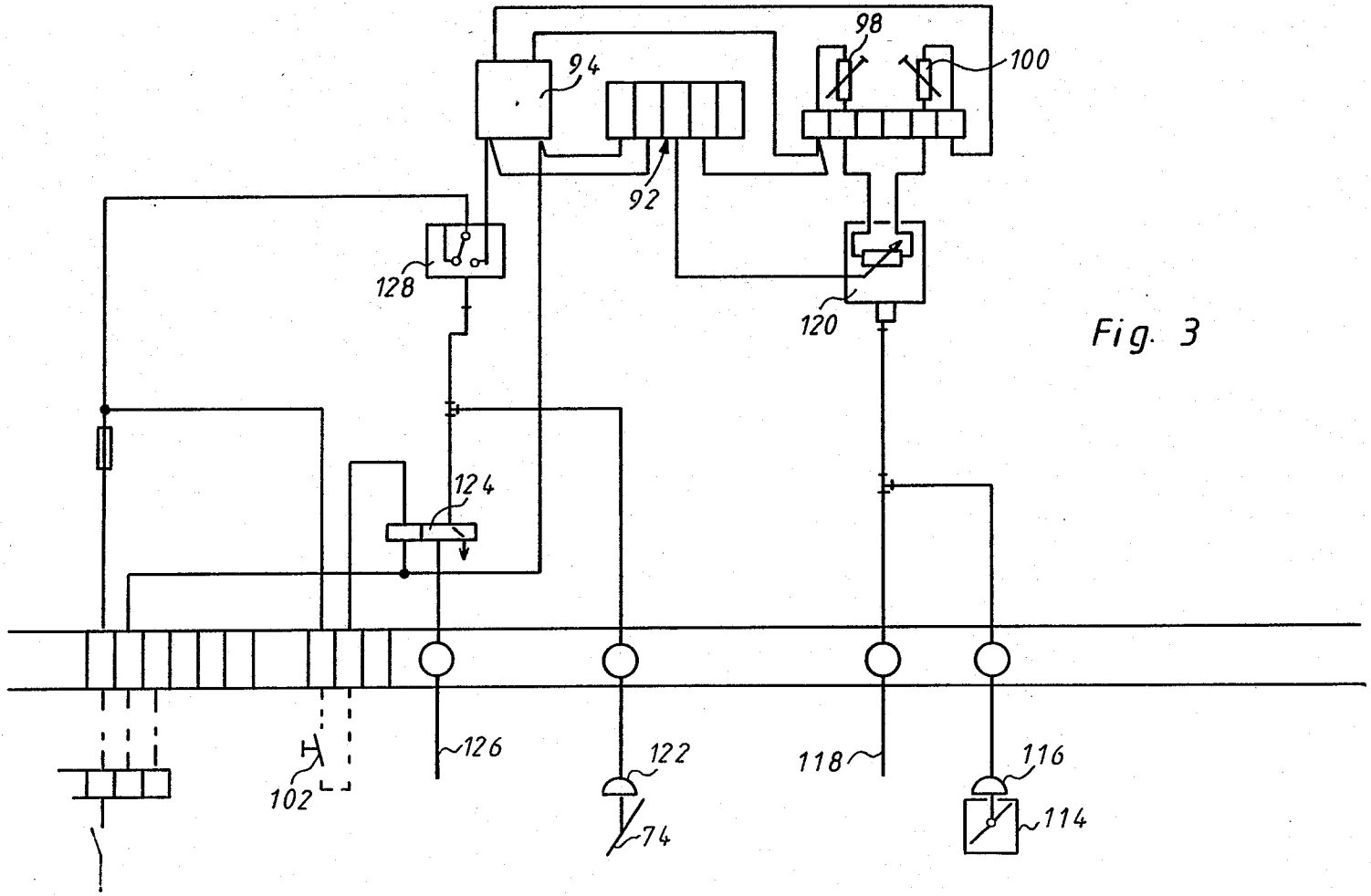
FIG. 3 shows a consumption metering system in combination with a pneumatic volume flow rate regulator.

FIG. 3 illustrates an embodiment wherein the servomotor for adjusting the setpoint of the volume flow rate regulator operates pneumatically. The basic construction is similar to FIG. 2, and corresponding parts are designated by the same reference numerals as in FIG. 2.

The volume flow rate regulator 114 has a pneumatic servomotor 116. A pneumatic input signal at an input 118 is applied to the pneumatic servomotor 116, said input signal being provided by a pneumatic controller. At the same time, this pneumatic input signal is applied to a pneumatic-electrical converter 120 which represents the signal generator and provides the output signal to be metered. Correspondingly also the servomotor 122 for the shut-off flap valve 74 (which corresponds to the servomotor 84 of FIG. 1) is a pneumatic servomotor. The relay 104 of FIG. 2 is replaced by a solenoid valve 124 which is arranged to connect the servomotor 122 to a source 126 of compressed air, when switch 102 is actuated. The meter 92 is switched off through a pneumatic manometer switch 128.

The fresh air supply and cooling installation of FIG. 1 is adapted to be changed over for optionally supplying cooled or non-cooled air. In this case, two meters can be provided which are switched over together with the changing-over of the fresh air and cooling installation, so that one meter is connected to the signal generator, when cooled air is supplied, and the other meter is connected to the signal generator, when non-cooled air is supplied. This amounts substantially to duplication of the arrangement illustrated in FIG. 2 and, therefore, is not shown in detail.

Then the consumption can be calculated as follows:

The total energy consumption for the supply of the non-cooled air is determined. Practically this is the energy for driving the blower 12. This energy consumption is distributed between the various building areas in the ratio of the consumption of non-cooled air, thus the meter readings which are obtained from the meters switched on with this mode of operation. Correspondingly the energy consumption is determined which has been metered in the period, for which the account is rendered. This energy consumption is also distributed between the individual building areas in the ratio of the cooled air consumed, i.e. of the meter readings of the meters switched on during cooling operation. Eventually the energy consumption which has been consumed by the heating device 72 is determined for each building area. In this way the proportions of the total energy consumption of the air conditioning system for the individual building areas can be determined fairly and accurately.

We claim:

1. Consumption metering system for an air conditioning system, wherein a plurality of building areas which are to be metered individually are supplied from a common fresh air supply and cooling installation through individual air ducts, comprising (a) one volume flow rate regulator arranged in each of said individual air ducts for regulating the volume flow rate to the associated building area, (b) each of said volume flow rate regulators having adjustable set point determining means and flow rate control means for controlling the through-flow area through said regulator, said flow rate control means being responsive to volume flow rate through said air duct and said flow rate control means being operatively connected with said setpoint determining means to vary said through-flow area when said volume flow rate deviates from a setpoint determined by said setpoint determining means, whereby the volume flow rate through said air duct is maintained substantially at a value equal to said setpoint, and means for adjusting said setpoint determining means, characterized by (c) a signal generator operatively connected to said setpoint adjusting means and formed to be adjusted together with said setpoint determining means, whereby said signal generator provides an output signal indicative of said setpoint, and (d) meter means to which said setpoint indicative output signal is applied for integrating said setpoint indicative output signal with respect to time and for providing a reading indicative of the volume of air flowing through said air duct.

2. Consumption metering system as claimed in claim 1, wherein said signal generator is a potentiometer.

3. Consumption metering system as claimed in claim 2, wherein said means for adjusting said setpoint determining means comprises a servomotor, said potentiometer being coupled to said servomotor to be adjusted thereby.

4. Consumption metering system as claimed in claim 2, wherein said meter means comprises a counter driven by an integrating motor.

5. Consumption metering system as claimed in claim 1, characterized by (a) a shut-off flap valve in said air duct and means for moving said shut-off flap valve between an open position and a closed position, and (b) means operatively connected to said shut-off flap valve for switching-off said meter means when said shut-off flap valve is in its closed position.

6. Consumption metering system as claimed in claim 5, wherein (a) said moving means comprises a servomotor coupled with said shut-off flap valve, a switch and a relay, said relay being arranged to be energized through said switch and having contact means for controlling said servomotor, (b) said switching-off means comprises a limit switch on the servomotor, said limit switch opening only when the shut-off flap valve is in its closed position, and (c) a power supply unit feeding said meter means is connected to the electric mains through said limit switch.

7. Consumption metering system as claimed in claim 1, characterized in that (a) a heating device (72) is arranged down-stream of each volume flow rate regulator (16) to heat the air supplied, and (b) means are provided for separately metering the energy consumption of each heating device (72).

8. Consumption metering system for an air conditioning system, wherein a plurality of building areas which are to be metered individually are supplied from a common fresh air supply and cooling installation through individual air ducts, comprising (a) one volume flow rate regulator arranged in each of said individual air ducts for regulating the volume flow rate to the associated building area, (b) each of said volume flow rate regulators having adjustable setpoint determining means and flow rate control means for controlling the through-flow area through said regulator, said flow rate control means being responsive to volume flow rate through said air duct said flow rate control means being operatively connected with said set point determining means to vary said through-flow area when said volume flow rate deviates from a setpoint determined by said setpoint determining means, whereby the volume flow rate through said air duct is maintained substantially at a value equal to said setpoint, and means for adjusting said setpoint determining means, characterized in that (c) said means for adjusting said adjustable setpoint determining means comprises a pneumatic servomotor responsive to a pneumatic input signal to adjust said setpoint determining means to a setpoint proportional to said pneumatic input signal, (d) a pneumatic-to-electric converter is provided, said pneumatic input signal also being applied to said pneumatic-to-electric converter, whereby said pneumatic-to-electric converter serves as a signal generator for providing an output signal indicative of said setpoint, and (e) meter means are provided, to which said setpoint indicative output signal is applied, for integrating said setpoint indicative output signal with respect to time and for providing a reading indicative of the volume of air flowing through said air duct.

9. Consumption metering system as claimed in claim 8, wherein said meter means comprises a counter driven by an integrating motor.

10. Consumption metering system for an air conditioning system, wherein a plurality of building areas which are to be metered individually are supplied from a common fresh air supply and cooling installation through individual air ducts, comprising (a) one volume flow rate regulator arranged in each of said individual air ducts for regulating the volume flow rate to the associated building area, (b) each of said volume flow rate regulators having adjustable setpoint determining means and flow rate control means for controlling the through-flow area through said regulator, said flow rate control means being responsive to volume flow rate through said air duct and said flow rate control means being operatively connected with said setpoint determining means to vary said through-flow area when said volume flow rate deviates from a setpoint determined by said setpoint determining means, whereby the volume flow rate through said air duct is maintained substantially at a value equal to said setpoint, and means for adjusting said setpoint determining means, characterized by (c) a signal generator operatively connected to said setpoint adjusting means and formed to be adjusted together with said setpoint determining means, whereby said signal generator provides an output signal indicative of said setpoint, (d) first and second meter means for integrating a signal applied thereto, with respect to time, (e) means for applying said setpoint indicative output signal either to said first or said second meter means, (f) means for changing over said fresh air supply and cooling installation to optionally supply cooled or non-cooled air, (g) means for changing-over said output signal applying means in synchronism with the changing-over of said cooled air or non-cooled air changing over means, whereby said first meter means is operative when cooled air is supplied and provides a reading indicative of the volume of cooled air flown through said air duct, and said second meter means is operative when non-cooled air is supplied and provides a reading indicative of the volume of non-cooled air flowing through said air duct.

* * * * *